US008450907B2

(12) United States Patent
Moon et al.

(10) Patent No.: US 8,450,907 B2
(45) Date of Patent: May 28, 2013

(54) SOUND GENERATOR FOR USE IN PARAMETRIC ARRAY

(75) Inventors: Won Kyu Moon, Gyeongsangbuk-do (KR); Haksue Lee, Pohang (KR); Yub Je, Busan (KR)

(73) Assignee: POSTECH Academy-Industry Foundation, Pohang-si (KR)

( * ) Notice: Subject to any disclaimer, the term of this patent is extended or adjusted under 35 U.S.C. 154(b) by 979 days.

(21) Appl. No.: 12/507,143

(22) Filed: Jul. 22, 2009

(65) Prior Publication Data

US 2010/0020990 A1 Jan. 28, 2010

(30) Foreign Application Priority Data

Jul. 23, 2008 (KR) ..... 10-2008-0071816

(51) Int. Cl.
*H04R 3/00* (2006.01)

(52) U.S. Cl.
USPC ..... 310/325; 310/334; 381/161

(58) Field of Classification Search
USPC ..... 310/325, 334; 381/161
See application file for complete search history.

(56) References Cited

U.S. PATENT DOCUMENTS

| | | | | |
|---|---|---|---|---|
| 5,299,175 | A | 3/1994 | Gallego-Juarez et al. | |
| 7,187,105 | B2 * | 3/2007 | Shiba | 310/325 |
| 2006/0001334 | A1 * | 1/2006 | Shiba | 310/325 |

FOREIGN PATENT DOCUMENTS

| | | | |
|---|---|---|---|
| JP | 2002-281584 | | 9/2002 |
| KR | 100774516 | B1 | 11/2007 |
| KR | 100781467 | B1 | 11/2007 |

OTHER PUBLICATIONS

English translation of KR 10-20060106683, Moon, Oct. 31, 2006.*
Extended European Search Report for European Application No. 09166076.1-1240 / 2148323, dated Dec. 23, 2010.

* cited by examiner

*Primary Examiner* — Walter Benson
*Assistant Examiner* — Bryan Gordon
(74) *Attorney, Agent, or Firm* — Occhiuti Rohlicek & Tsao LLP

(57) ABSTRACT

A sound generator includes a transducer converting electric energy to mechanical energy, a mechanical amplifier mechanically amplifying a vibration generated in a piezoelectric component of the transducer, and a radiation plate radiating a sound wave from a signal amplified by the mechanical amplifier, wherein the radiation plate includes a first step having a height for compensating for a first resonance frequency and a second step having a height for compensating for a second resonance frequency.

11 Claims, 15 Drawing Sheets

SOUND GENERATOR FOR USE IN PARAMETRIC ARRAY

CROSS-REFERENCE TO RELATED APPLICATIONS

This application claims the benefit of priority of U.S. Korean Patent Application No. 10-2008-0071816 filed on Jul. 23, 2008 which is incorporated by reference in its entirety herein.

FIELD OF THE INVENTION

The present invention relates to a sound generator, and more particularly, to a sound generator capable of generating high-sound-pressure and high-directivity sound waves in two frequency bands to cause an airborne parametric array mechanism.

The invention can be applied to devices requiring two high-power directional sound waves, such as an ultrasonic distance sensor based on a parametric array.

The invention can be also applied to an ultrasonic distance-sensing transducer based on a parametric array.

DESCRIPTION OF THE RELATED ART

In general, the directivity of a sound wave generated from a sound generator is expressed as a function of the frequency k and the size of a radiation plate a. As shown in FIG. 1, as the frequency of the sound wave becomes higher and the size of the radiation plate becomes greater, it is possible to generate a higher-directivity sound wave. When ka=100, the directivity of a sound wave is higher than that when ka=1. However, when the frequency is raised to secure the high directivity, the traveling distance of the sound wave is shortened due to a high attenuation effect. A physical restriction exists in increasing the size of the radiation plate.

In order to solve the above-mentioned problem, a method of generating a sound wave using a parametric array mechanism having been applied to the sonar was suggested. The parametric array mechanism is a nonlinear phenomenon of a medium occurring when a high-pressure sound wave travels therethrough. As shown in FIG. 2, when high-pressure signals $f_1$ and $f_2$ are generated from a sound generator, various harmonic signals such as $2f_1$, $2f_2$, $f_2+f_1$, and $f_2-f_1$ are generated due to the nonlinear phenomenon of the medium, in addition to the directly generated signals $f_1$ and $f_2$. When $f_d=f_2-f_1<<f_1$ or $f_2$, the signals $f_1$, $f_2$, $2f_1$, $2f_2$, and $f_2+f_1$ having relatively high frequencies are faded rapidly due to the high attenuation effect, but only the signal $f_d$ having a relative low frequency is maintained. Regarding this differential frequency signal $f_d$, since line-like sound sources are distributed in the medium, the directivity similar to that of the high-frequency signals $f_1$ and $f_2$ can be obtained. Therefore, the sound generator employing the parametric array mechanism can generate high-directivity sound waves at low frequencies.

In general, the radiation impedance in water is higher than that in air and thus high-pressure sound waves can be more easily generated. The value of a nonlinear constant for determining the efficiency of the nonlinear effect in water is also greater (ex. 3.5 in water and 1.2 in air). Therefore, the parametric array mechanism can be embodied in water with a higher efficiency than that in air. In order to embody the parametric array mechanism in air, it is necessary to generate strong sound waves at two frequencies to overcome the low efficiency. In general, a parametric driver in air is driven using an array which can be driven with a large radiation area.

However, this method requires much cost for manufacturing a transducer and requires great power consumption.

U.S. Pat. No. 5,299,175 (Jan. 19, 1993), entitled "Electroacoustic unit for generating high-sonic and ultra-sonic intensities in gases and interphases", suggested a stepped plate transducer having very high efficiency and output power in air. It can be seen from FIG. 3 that the radiation characteristic of a non-stepped radiation plate due to a distorted vibration is poor. As shown in FIG. 4, the stepped transducer employs a method of compensating for a phase difference in a vibration mode of the radiation plate by forming steps, which have a height corresponding to a half wavelength of a sound wave in air, in the radiation plate. Since the stepped transducer has a large radiation area, it is possible to generate sound waves with higher efficiency, higher sound pressure, and higher directivity than the existing transducers. Since the stepped transducer has a simple structure, it is possible to manufacture the stepped transducer at low cost. Since the stepped transducer could compensate for the phase difference at only one frequency, it could strongly generate only one frequency signal. However, since high-pressure sound waves at two or more frequencies are necessary to cause the parametric array mechanism, it is difficult to apply the stepped transducer for the parametric array mechanism.

On the other hand, as shown in FIG. 5, an ultrasonic distance sensor includes a transmitter (actuator) generating ultrasonic waves and a receiver (sensor) receiving reflected sound waves. The ultrasonic distance sensor mainly uses ultrasonic pulses at the frequency band of 20 to 60 kHz to measure a distance of several m or more in air. The ultrasonic distance sensor measures the distance by calculating the time until an ultrasonic wave is reflected from an object and is then sensed by the receiver after the ultrasonic wave is generated from the transmitter. In general, the spatial resolution of the ultrasonic distance sensor is proportional to the directivity of the ultrasonic wave. As the directivity angle of an ultrasonic wave becomes smaller, the spatial resolution becomes higher. The ultrasonic distance sensor has a defect that the spatial resolution is small due to the great directivity angle.

The transducers used in the ultrasonic distance sensor are classified into an electrostatic capacitive type and a piezoelectric type depending on the driving type thereof. In general, the piezoelectric transducer includes a transmitting actuator and a receiving sensor which are separated from each other, and the electrostatic capacitive transducer includes a combined transmitter and receiver.

The existing ultrasonic distance sensor generally has a directivity angle (HPBW: Half Power Beam Width) of about 20° to 50° with a size D of 1 to 5 cm. When the directivity angle is in the range of 20° to 50°, the spatial resolution has a magnitude similar thereto. A distance sensor employing the parametric array mechanism was suggested to solve the problem that the resolution of the ultrasonic distance sensor is small. In the parametric array mechanism, since high directivity can be guaranteed with a low-frequency signal, it is possible to guarantee the directivity angle of about 3° to 5° with a signal of 20 to 60 kHz and a size D of 1 to 3 cm.

Two frequency signals should be generated with a high sound pressure and high directivity so as to embody the parametric array mechanism. In recent years, an airborne parametric array driver employs a piezoelectric film or array to guarantee a large radiation area. An array transducer is designed to have resonance frequencies in two frequency bands by arranging plural unit transducers having different resonance frequencies. However, the array transducer has a problem that much cost and great power consumption are required to manufacture the unit transducers.

Therefore, there is a need for a sound generator capable of efficiently embodying the parametric array mechanism.

SUMMARY OF THE INVENTION

An advantage of some aspects of the invention is that it provides a sound generator capable of efficiently embodying a parametric array mechanism.

According to an aspect of the invention, there is provided a sound generator including: a transducer converting electric energy to mechanical energy; a mechanical amplifier mechanically amplifying a vibration generated in a piezoelectric component of the transducer; and a radiation plate radiating a sound wave from a signal amplified by the mechanical amplifier, wherein the radiation plate includes a first step having a height for compensating for a first resonance frequency and a second step having a height for compensating for a second resonance frequency.

According to another aspect of the invention, there is provided a sound generation driving system including: a signal generator modulating a signal for generating a parametric array mechanism; a signal amplifier amplifying the signal modulated by the signal generator; and a sound generator converting the signal amplified by the signal amplifier into a sound wave, wherein the sound generator includes a radiation plate radiating a sound wave, and the radiation plate includes a first step having a height for compensating for a first resonance frequency and a second step having a height for compensating for a second resonance frequency.

Since the sound generator is driven with a single transducer having a simple structure, it is possible to manufacture the sound generator at lower cost than an array transducer. In addition, it is possible to improve the directivity characteristic of sound waves with low power and a great radiation area.

DETAILED DESCRIPTION OF THE INVENTION

Figure 1:
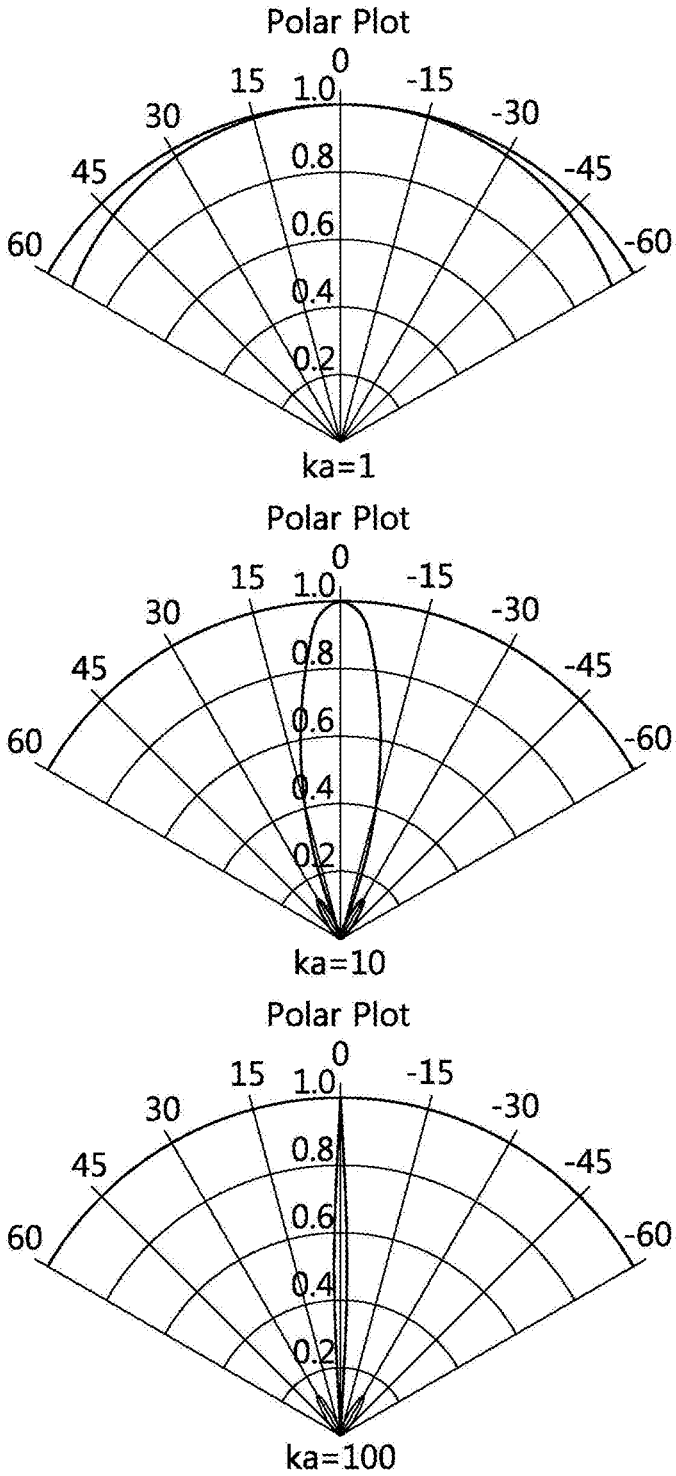
FIG. 1 is a diagram illustrating directivity characteristics of typical sound waves.
Figure 2:
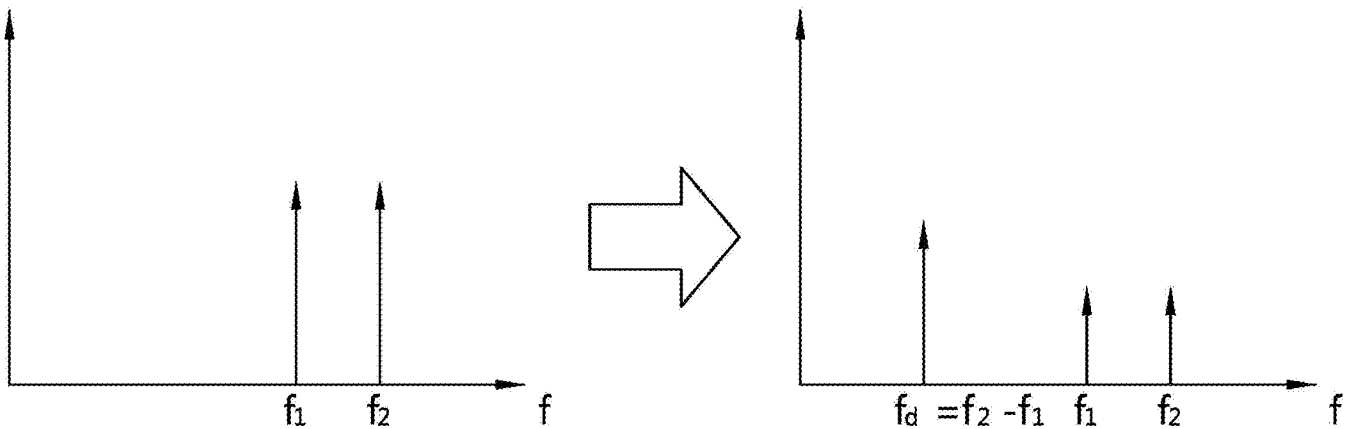
FIG. 2 is a diagram illustrating a parametric array mechanism in a frequency domain.
Figure 3:
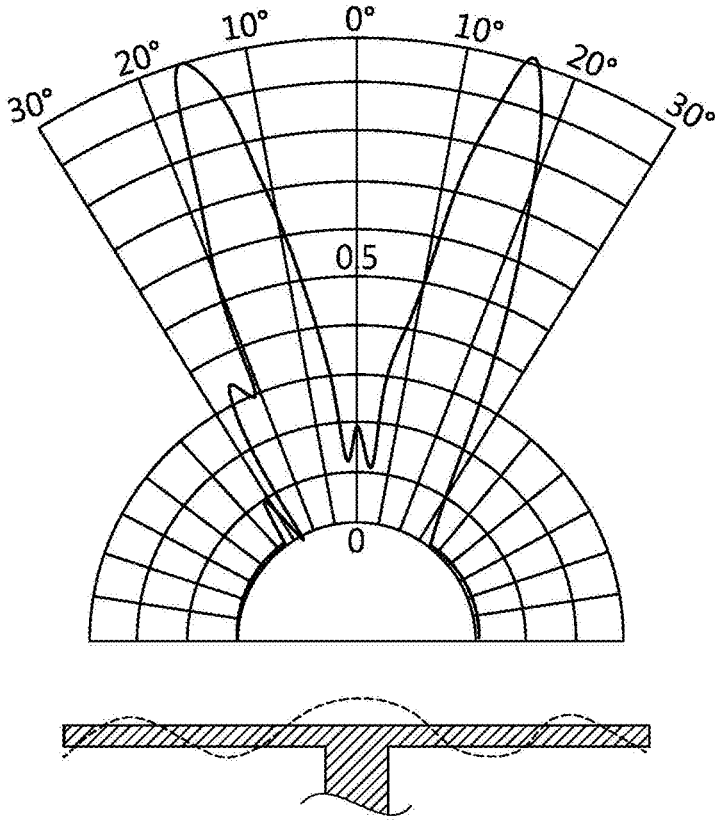
FIG. 3 is a diagram illustrating a radiation characteristic due to a distorted vibration of a radiation plate without any step.
Figure 4:
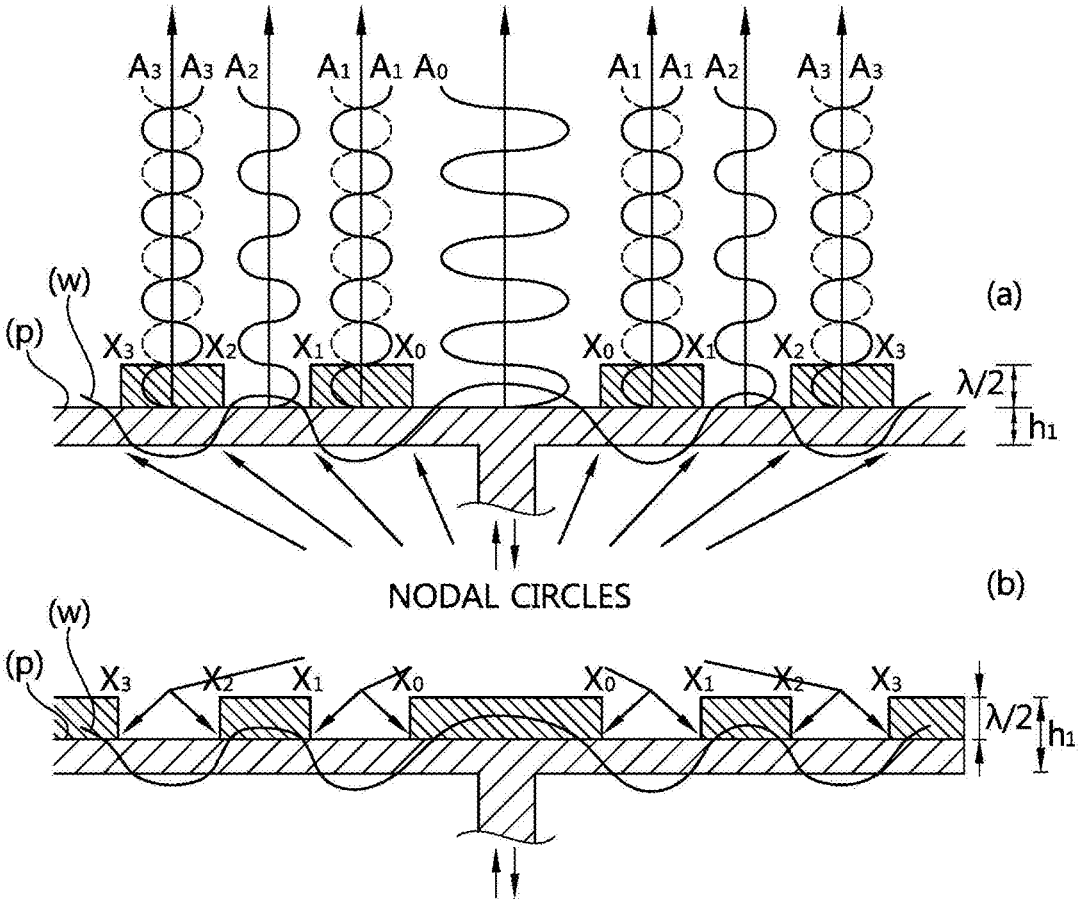
FIG. 4 is a diagram illustrating a principle of compensating for a distorted vibration of a stepped transducer.
Figure 5:
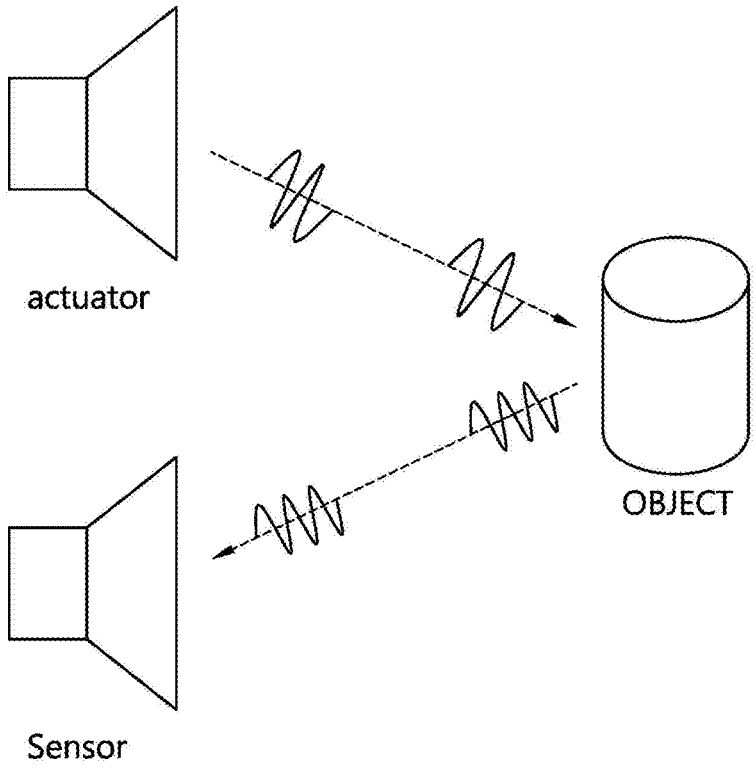
FIG. 5 is a diagram illustrating a measurement principle of an ultrasonic distance sensor.
Figure 6:
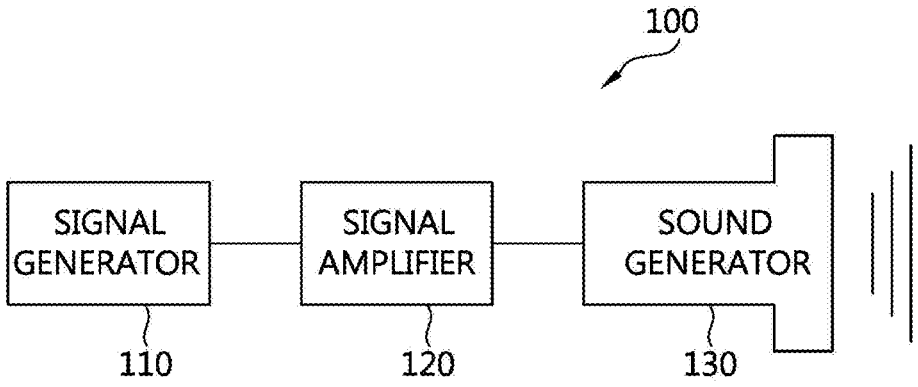
FIG. 6 is a block diagram schematically illustrating a configuration of a sound generation driving system according to an embodiment of the invention.
Figure 7:
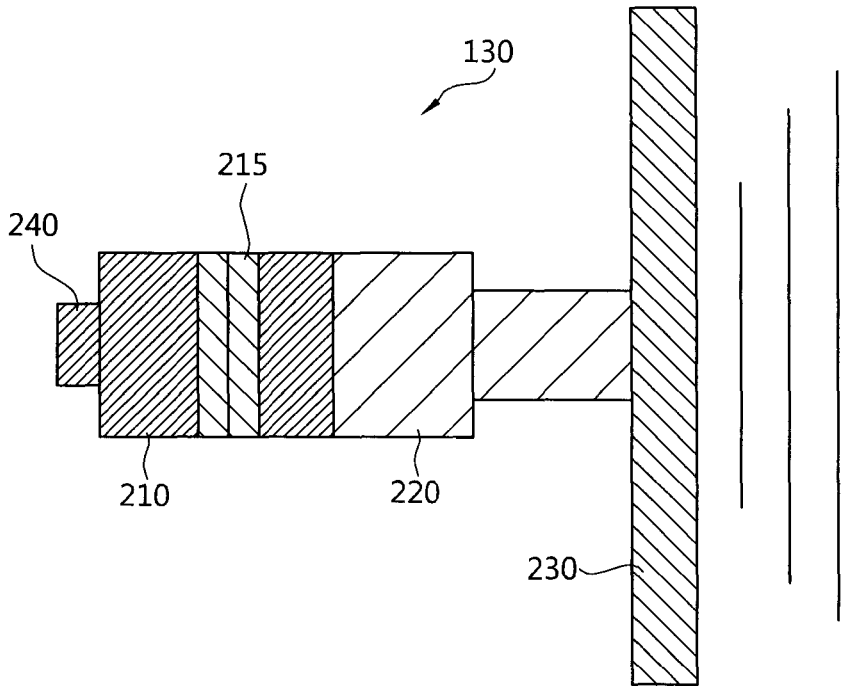
FIG. 7 is a diagram illustrating a structure of a sound generator according to an embodiment of the invention.

FIG. 6 is a diagram illustrating the configuration of a sound generation driving system according to an embodiment of the invention. FIG. 7 is a diagram illustrating the structure of a sound generator according to an embodiment of the invention.

Referring to FIGS. 6 and 7, the sound generation driving system 100 includes a signal generator 110, a signal amplifier 120, and a sound generator 130. The signal generator 110 modulates a signal for causing the parametric array mechanism. The signal amplifier 120 amplifies the modulated signal and transmits the amplified signal to the sound generator 130. The sound generator 130 converts the amplified signal into sound waves. The sound generation driving system 100 can be called a system for driving a stepped transducer generating sound waves having two resonance frequencies.

The sound generator 130 includes a transducer 210, a driving material 215, a mechanical amplifier 220, and a radiation plate 230. The transducer 210 converts electric energy into mechanical energy. Piezoelectric ceramics can be used as the driving material 215 and a Langevin type transducer to which a piezoelectric component is fastened with a bolt 240 can be used as the transducer 210. The mechanical amplifier 220 mechanically amplifies vibrations generated from the piezoelectric component using a horn shape. The mechanical amplifier 220 can be formed of a horn having various structures such as a stepped horn, a linear horn, and an exponential horn. The radiation plate 230 radiates sound waves from the amplified signal. The mechanical amplifier 220 and the radiation plate 230 can be formed of various materials such as elastic metal and polymer compounds. The radiation plate 230 has a structure for generating high-pressure and high-directivity sound waves at two frequencies so as to embody the parametric array mechanism using the added step. The sound generator 130 employing the radiation plate 230 having steps can be called stepped transducer.

Figure 8:
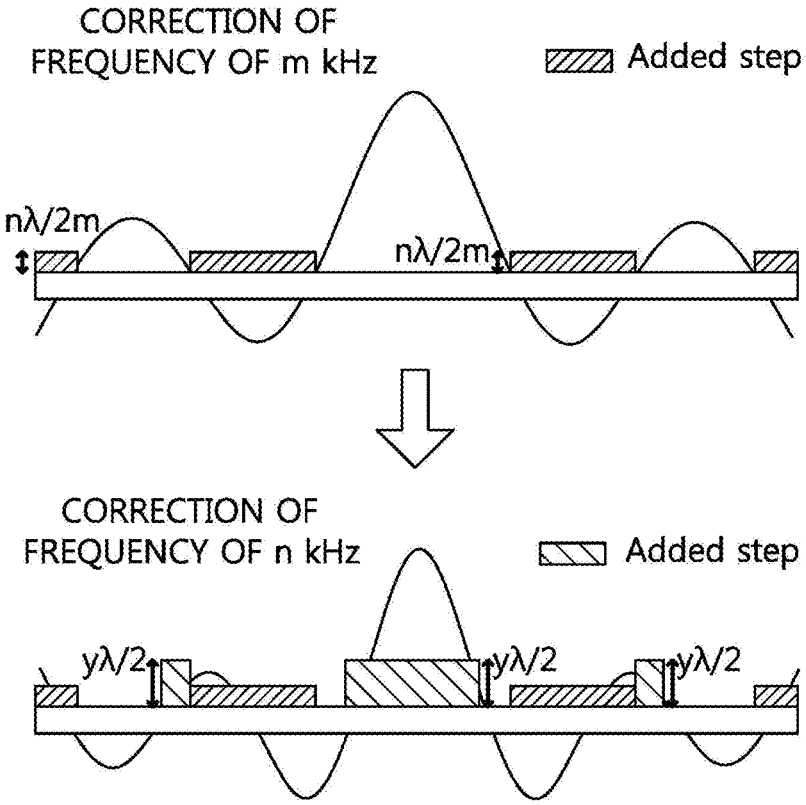
FIG. 8 is a diagram illustrating a compensation principle in a radiation plate of the sound generator according to an embodiment of the invention.

FIG. 8 is a diagram illustrating the compensation principle in the radiation plate of the sound generator according to the embodiment of the invention.

Referring to FIG. 8, a past stepped transducer could generate high-pressure sound waves at only one frequency, but the sound generator according to the embodiment of the invention can make compensation in two resonance modes by correcting the height and position of the steps of the radiation plate.

The compensating method in two resonance modes using the steps is as follows.

It is assumed that the resonance frequencies of the radiation plate are m kHz and n kHz. An operation mode in which the resonance frequency is m is called m mode and an operation mode in which the resonance frequency is n is called n mode. When the wavelength of a sound wave in air in the n mode is represented by $\lambda$, the wavelength of the sound wave in air in the m mode can be expressed by $(n/m)\lambda$. Since the height of the step required for compensation is an odd times the half wavelength of the sound wave in air, the height of the step required for compensating for a phase is (n/2 m)λ, (3 n/2 m)λ, (5 n/2 m)λ, . . . in the m mode and is (1/2)λ, (3/2)λ, (5/2)λ, . . . in the n mode.

The vibration in the m mode can be compensated for by the step having a height of (n/2 m)λ. When the height of the step for compensating for the vibration in the n mode is determined by x times the in-air wavelength (n/m)λ in the m mode, it is possible to compensate for the vibration in the n mode without influencing the compensation method in the m mode (x is an integer).

The height of the step for compensating for the vibration in the n mode can be determined by Equation 1.

$$x\frac{n}{m}\lambda = \frac{y}{2}\lambda \qquad \text{[Equation 1]}$$

Here, x=1, 2, 3, . . . and y=1, 3, 5, . . . n and m represent resonance frequencies and λ represents the wavelength of a sound wave in air. When x and y are determined to satisfy Equation 1, it is possible to compensate for the vibration in the n mode without interference with the vibration in the m mode. Therefore, the vibration in the m mode can be compensated for by the use of the step having a height of (n/2 m)λ and the vibration in the n mode can be compensated for by the use of the step having a height of (y/2)λ.

The compensating procedure is as follows. First, the vibration mode at m kHz is completely compenstated for with the step having a height of (n/2 m)λ. Then, the vibration mode at n kHz is partially compensated for with the step having a height of (y/2)λ. Since the height (y/2)λ is equal to the wavelength at n kHz, it is possible to compensate for the vibration mode at m kHz without influencing the sound wave generated at the resonance frequency of n kHz.

Therefore, the stepped transducer according to an embodiment of the invention can radiate high-pressure and high-power sound waves at two frequencies.

Figure 9:
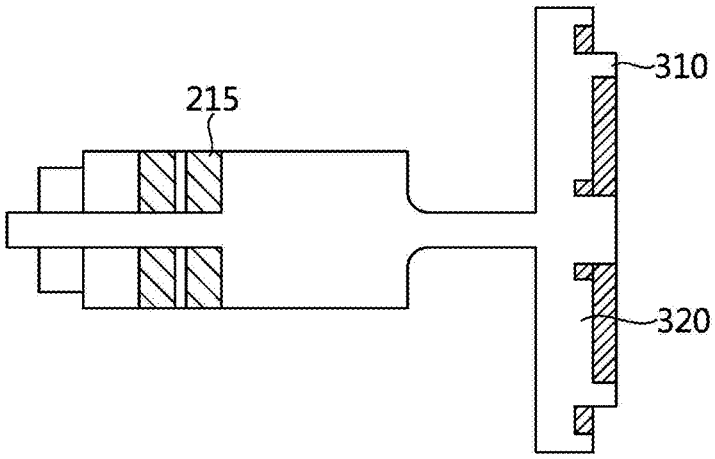
FIG. 9 is a diagram illustrating a structure of a sound generator employing a radiation plate with an added step according to an embodiment of the invention.

FIG. 9 is a diagram illustrating a sound generator employing an added-step radiation plate according to an embodiment of the invention.

Referring to FIG. 9, by adding a first step 310 and a second step 320 to an even radiation plate, it is possible to compensate for the resonance modes at two resonance frequencies. The first step 310 and the second step 320 may be provided to the entire radiation plate as shown in the drawing, or may be provided to divided areas of the radiation plate.

Figure 10:
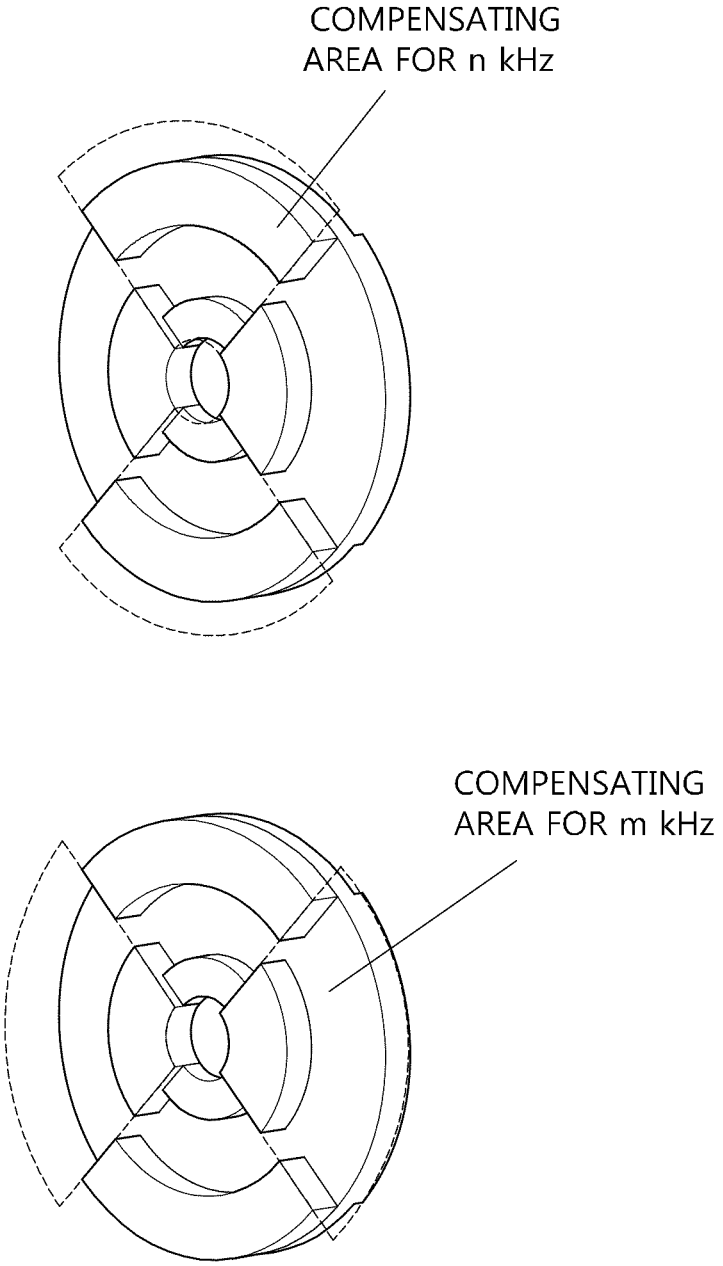
FIG. 10 is a diagram illustrating a compensation principle in a radiation plate of a sound generator according to another embodiment of the invention.

FIG. 10 is a diagram illustrating a compensating principle of a radiation plate of a sound generator according to another embodiment of the invention.

Referring to FIG. 10, the radiation plate is divided into a compensating area for the resonance frequency of m kHz and a compensating area for the resonance frequency of n kHz to make compensation at two resonance frequencies of m kHz and n kHz. The steps with a height of (n/2 m)λ are formed in the compensating area for the resonance frequency of m kHz to compensate for the vibration mode. The steps with a height of (y/2)λ are formed in the compensating area for the resonance frequency of n kHz to compensate for the vibration mode. That is, the steps corresponding to half wavelengths of the resonance frequencies are formed in the areas to generate the sound waves of the same phase.

The effect of the radiation plate can be confirmed using the Rayleigh integral. The Rayleigh integral is used to obtain beam patterns corresponding to the mode shapes of the radiation plate and integrates the radiation area by considering a minute area of the radiation plate as a simple source.

Figure 11:
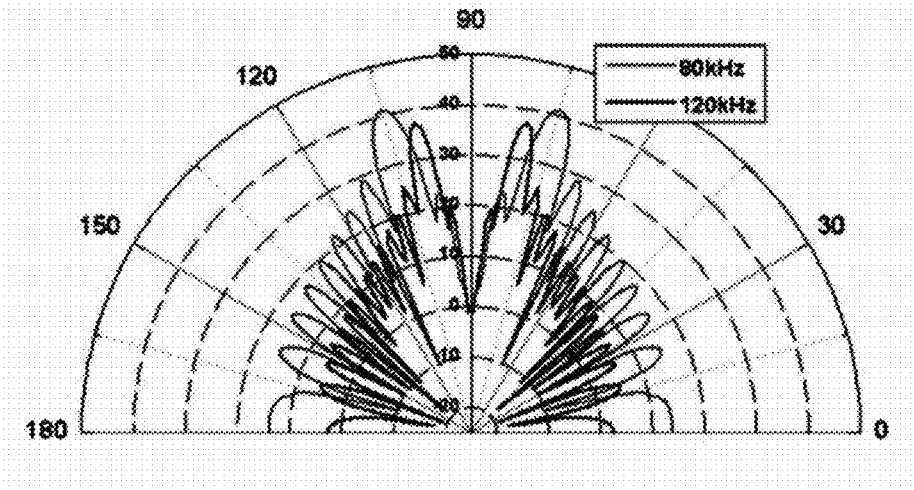
FIG. 11 is a diagram illustrating a radiation characteristic of an even radiation plate using the Rayleigh integral.
Figure 12:
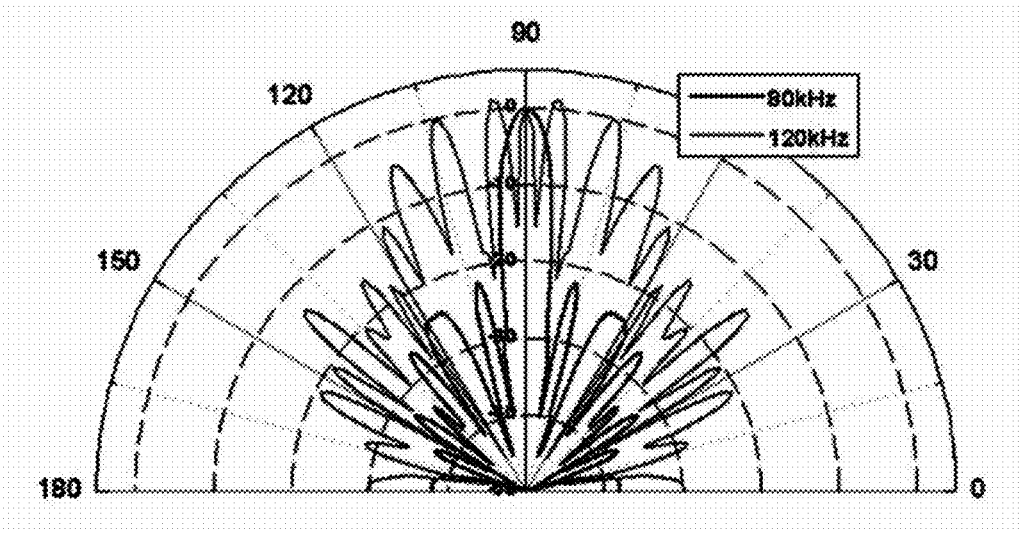
FIG. 12 is a diagram illustrating a radiation characteristic of a known stepped radiation plate using the Rayleigh integral.
Figure 13:
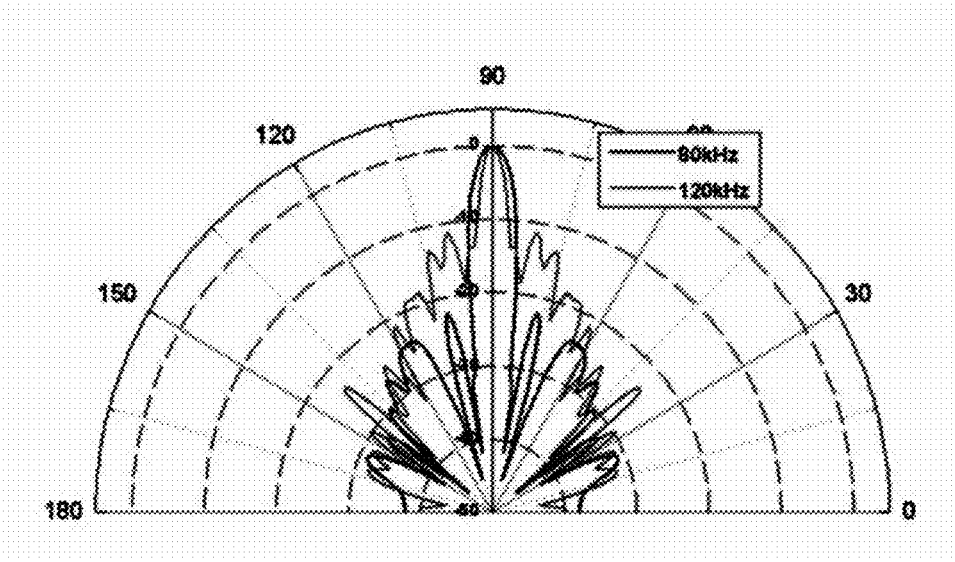
FIG. 13 is a diagram a radiation characteristic of a stepped radiation plate according to the embodiment of the invention using the Rayleigh integral.

FIG. 11 is a diagram illustrating the radiation characteristic of the even radiation plate using the Rayleigh integral. FIG. 12 is a diagram illustrating the radiation characteristic of the past stepped radiation plate using the Rayleigh integral. FIG. 13 is a diagram illustrating the radiation characteristic of the stepped radiation plate according to the embodiment of the invention using the Rayleigh integral. Here, the resonance frequencies are 80 kHz and 120 kHz.

Referring to FIGS. 11 to 13, it can be seen that the directivity characteristics of the even radiation plate in the vibration modes of 80 kHz and 120 kHz are poor. The past stepped radiation plate exhibits a good radiation characteristic in the vibration mode of 80 kHz where the phase is corrected, but exhibits a poor directivity characteristic in the vibration mode of 120 kHz where the phase is not corrected. The stepped radiation plate according to the embodiment of the invention exhibits good directivity characteristics in two vibration modes of 80 kHz and 120 kHz. Therefore, it can be confirmed that the stepped radiation plate according to the embodiment of the invention can generate high-pressure and high-directivity sound waves at two resonance frequencies.

Figure 14:
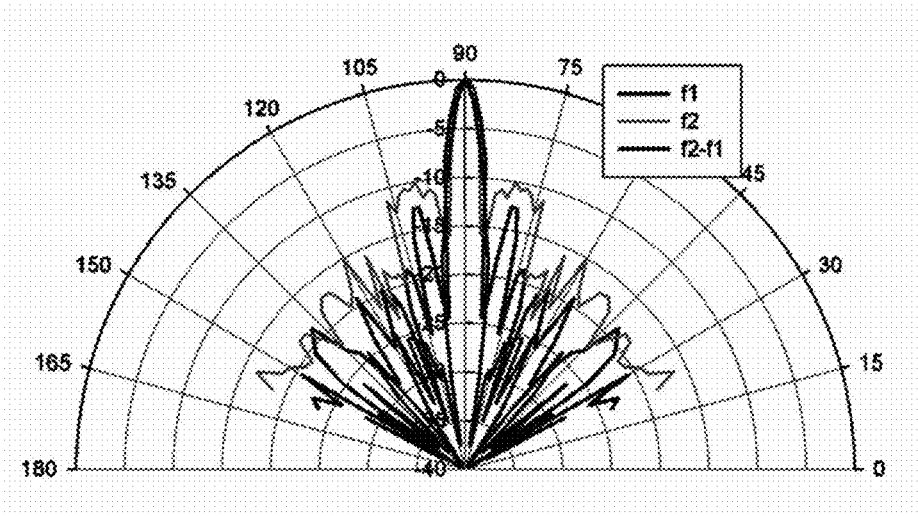
FIG. 14 is a diagram illustrating the directivity characteristic of the sound generator according to the embodiment of the invention.
Figure 15:
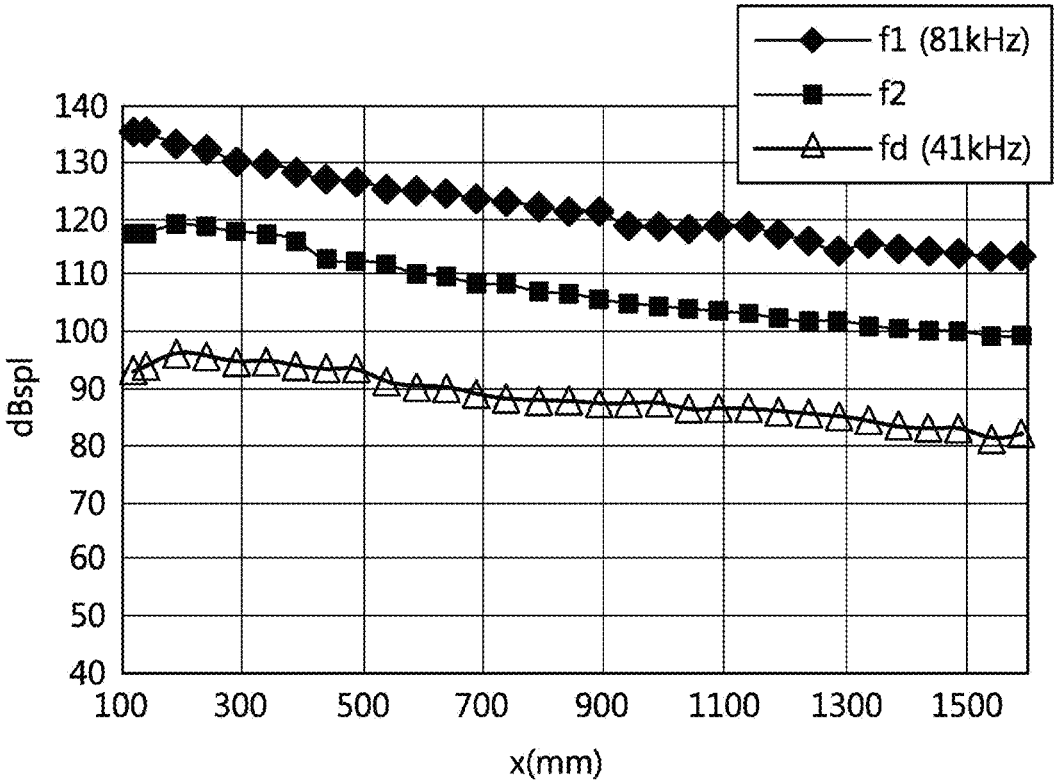
FIG. 15 is a sound pressure distribution depending on a distance in the sound generator according to the embodiment of the invention.

FIG. 14 is a diagram illustrating the directivity characteristic of the sound generator according to the embodiment of the invention. FIG. 15 is a diagram illustrating a sound pressure distribution depending on a distance in the sound generator according to the embodiment of the invention.

Referring to FIGS. 14 and 15, it shows the test results on the directivity characteristic of the sound generator according to the embodiment of the invention. It can be confirmed that high-directivity ultrasonic waves with a directivity angle of about 5° are generated at two frequency bands $f_1$ and $f_2$ and a high sound pressure of 130 dB or more can be secured. A differential sound wave $f_d=f_2-f_1$ was generated due to the parametric array mechanism in air and a high-directivity low-frequency signal (with about 40 kHz) was generated with a directivity angle of the differential sound wave of 3.5° and a sound pressure of about 95 dB.

The sound generator for embodying the parametric array mechanism is provided in the invention. The sound generator can be applied to a sonar system having a high spatial resolution with a small area, which is used in the sonar or the undersea exploration employing the parametric array mechanism. The sound generator can be applied to an airborne ultrasonic distance sensor, thereby enhancing the spatial resolution of the ultrasonic distance sensor. The sound generator can be applied to an ultrasonic speaker requiring high directivity.

Although the exemplary embodiments of the invention have been described in detail, it can be understood by those skilled in the art that the invention can be modified or changed in various forms without departing from the spirit and scope of the invention defined by the appended claims. Therefore, the modifications and changes belong to the technical spirit of the invention.

What is claimed is:

1. A sound generator comprising:

a transducer configured for converting electric energy to mechanical energy;

a mechanical amplifier configured for mechanically amplifying a vibration generated in a piezoelectric component of the transducer; and a radiation plate configured for radiating a sound wave from a signal amplified by the mechanical amplifier, wherein the radiation plate includes a first step and a second step, the first step having a first height, the first height being an odd multiple of a half of an in-air wavelength of the sound wave at a first resonance frequency of the radiation plate, the second step having a second height, the second height being an odd multiple of a half of an in-air wavelength of the sound wave at a second resonance frequency of the radiation plate and an integer multiple of the wavelength of the sound wave at the first resonance frequency.

2. The sound generator according to claim 1, wherein the first height is $(n/2\ m)\lambda$ and the second height $(y/2)\lambda$ satisfies $(y/2)\lambda=x(n/m)\lambda$ for an integer x and an odd integer y, where m represents the first resonance frequency, n represents the second resonance frequency, and $\lambda$ represents an in-air wavelength of the second resonance frequency.

3. The sound generator according to claim 1, wherein the transducer is a Langevin type transducer of which a piezoelectric component is fastened with a bolt.

4. The sound generator according to claim 1, wherein the mechanical amplifier has at least one structure of a stepped horn, a linear horn, and an exponential horn.

5. The sound generator according to claim 1, wherein the radiation plate is formed of an elastic material.

6. The sound generator according to claim 1, wherein the radiation plate is divided into a first area including a plurality of first steps and a second area including a plurality of the second steps.

7. The sound generator according to claim 1, wherein the radiation plate is used for generating a parametric array mechanism.

8. A radiation plate for radiating a sound wave, comprising:

a plate;

a first step formed on the plate; and a second step formed on the plate, wherein the first step has a first height, the second step has a second height, the first height is an odd multiple of a half of an in-air wavelength of the sound wave at a first resonance frequency of the radiation plate, and the second height is an odd multiple of a half of a wavelength of the sound wave at a second resonance frequency of the radiation plate and an integer multiple of the wavelength of the sound wave at the first resonance frequency.

9. The radiation plate according to claim 8, wherein the first height is $(n/2\ m)\lambda$ and the second height $(y/2)\lambda$ satisfies $(y/2)\lambda=x(n/m)\lambda$ for an integer x and an odd integer y, where m represents the first resonance frequency, n represents the second resonance frequency, and $\lambda$ represents an in-air wavelength of the second resonance frequency.

10. The radiation plate according to claim 8, wherein the plate, the first step and the second step are formed of an elastic material.

11. The radiation plate according to claim 8, wherein the plate is divided into a first area and a second area, and wherein a plurality of first steps are formed on the first area and a plurality of second steps are formed on the second area.

* * * * *